US006073304A

United States Patent [19]

Knowlton et al.

[11] Patent Number: 6,073,304

[45] Date of Patent: Jun. 13, 2000

[54] SQUEEGEE ADJUSTMENT METHOD AND APPARATUS

[75] Inventors: Christopher M. Knowlton, Pinehurst, N.C.; Robert J. O'Hara, Castle Rock, Colo.

[73] Assignee: Windsor Industries, Inc., Englewood, Colo.

[21] Appl. No.: 09/133,920

[22] Filed: Aug. 13, 1998

Related U.S. Application Data

[60] Provisional application No. 60/062,730, Oct. 22, 1997.

[51] Int. Cl.[7] ..... A47L 7/00

[52] U.S. Cl. ..... 15/401; 15/320; 15/339

[58] Field of Search ..... 15/320, 401

[56] References Cited

U.S. PATENT DOCUMENTS

| | | | |
|---|---|---|---|
| 3,065,490 | 11/1962 | Arones | 15/401 X |
| 3,206,787 | 9/1965 | Daniels et al. | 15/320 |
| 3,376,597 | 4/1968 | Boyd | 15/320 |
| 3,866,541 | 2/1975 | O'Connor et al. | 15/320 X |
| 3,939,518 | 2/1976 | Whitney et al. | 15/401 X |
| 4,037,289 | 7/1977 | Dojan | 15/320 |
| 4,293,971 | 10/1981 | Block | 15/320 X |
| 4,653,424 | 3/1987 | Schloss et al. | 118/108 |
| 5,628,086 | 5/1997 | Knowlton et al. | 15/340.1 |

*Primary Examiner*—Chris K. Moore
*Attorney, Agent, or Firm*—Sheridan Ross, P.C.

[57] ABSTRACT

Squeegee adjustment in connection with a floor maintenance mechanism is provided. A single adjustment such as a laterally movable camming bar, permits rapid and reproducible squeegee height adjustment without the need for tools. A spring-urged squeegee pitch coupling is adjustable by a manually operable knob. Indicators or gauges provide an operator with information regarding the current height and/or pitch value of the squeegee.

7 Claims, 12 Drawing Sheets

SQUEEGEE ADJUSTMENT METHOD AND APPARATUS

This appln. claims benefit of provisional appln. 60/062,730 issued Oct. 22, 1997.

The present invention is directed to adjustment of a squeegee used in connection with a mechanized floor maintenance device and in particular to a method and apparatus for adjusting the pitch and/or height of the squeegee.

BACKGROUND INFORMATION

Mechanized floor maintenance devices are often employed in floor maintenance for large facilities such as grocery or other retail stores, warehouses, factories and the like. Such mechanized floor maintenance devices are typically configured with wheels or endless tracks, permitting the mechanism to move over a floor or other substantially horizontal surface, either by being pushed or by being fully or partially self-propelled. Such mechanized floor maintenance devices include any or all of a variety of floor maintenance components including fluid application components, scrubbing components, vacuum components and drying components. When drying components are provided, it is common to include one or more squeegees for contacting the floor. Such squeegees should be properly adjusted in order to achieve the desired maintenance or finish on a floor and to avoid leaving undesired liquid in the trail of the floor maintenance device. Squeegee adjustment may become necessary as a result of ordinary wear, replacement of squeegee blades or other components, changes in temperature or other environmental factors and/or changes in the characteristics of the floor to be maintained (such as surface roughness, texture, hardness, water permeability and the like). Typically, squeegee adjustment in such floor maintenance devices has been relatively time-consumptive and labor-intensive, often involving a trial-and-error process of repeated adjustments and inspection of results. In previous devices, adjustments typically could not be readily reproduced and operators were provided with substantially no readily-discernable information about current adjustment values. These factors have resulted in a situation in which an undesirably large amount of time is spent in squeegee adjustment, often with less than desirable results. Accordingly, it would be useful to facilitate squeegee adjustment in floor maintenance devices, preferably in a manner which is at least partially reproducible e.g. by and/or which provides information on current adjustment values.

SUMMARY OF THE INVENTION

The present invention provides a apparatus and method by which one or more squeegee devices of a floor maintenance device may be adjusted with reduced time or effort, increased reproducibility and/or increased information or feedback. In one embodiment, an adjustment determines the height of the squeegee assembly with respect to the floor thus affecting the amount of pressure of the squeegee blade with respect to the floor and/or the flare of the floor-contact edge of the squeegee blades. Preferably the height adjustment includes a pointer or other indicator showing the current height adjustment value. Preferably, the indicator includes indicia showing values or ranges of values which may be correlated with conditions such as the type of floor surface to be worked upon. Preferably, the height adjustment may be easily effected such as by sliding a single plate or lever and may be locked into position, such as by a hand-operable knob. Preferably the height adjustment may be made manually without the use of or need for tools.

According to one embodiment, the pitch or angle of one or more squeegee blades with respect to the floor surface can be adjusted. Preferably a level (e.g. bubble-level)or other angle indicator provides information regarding the current pitch adjustment. Preferably the pitch adjustment may be made relatively easily such as by adjustment of a single pitch knob. Preferably pitch adjustment may be effected manually without the need for tools.

DETAILED DESCRIPTION OF THE PREFERRED EMBODIMENT

Figure 1:
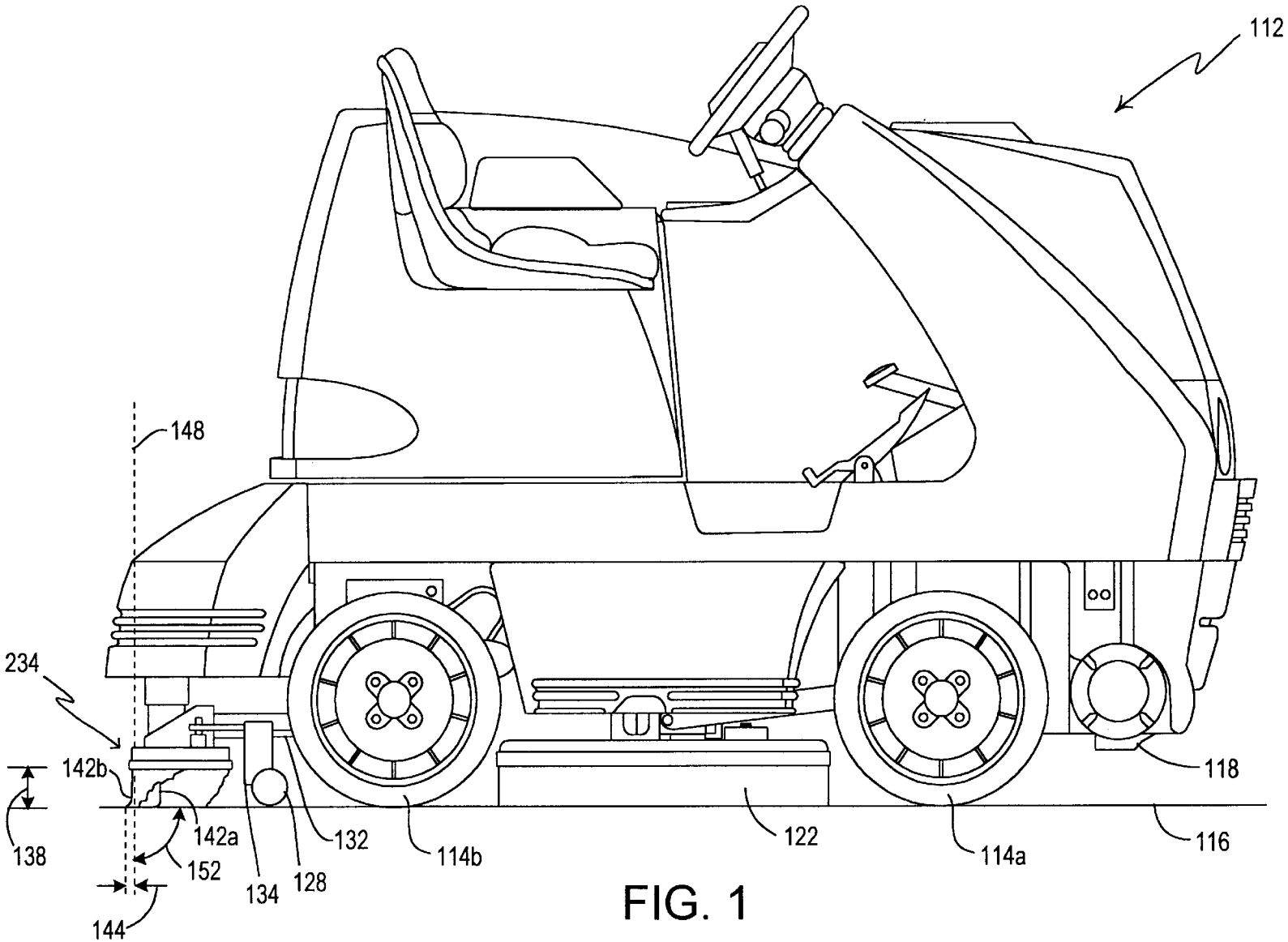
FIG. 1 is a side view of a floor maintenance device of a type which may be used in connection with the present invention with a squeegee assembly shown partly cut away, and partly in a block diagram form.
Figure 2:
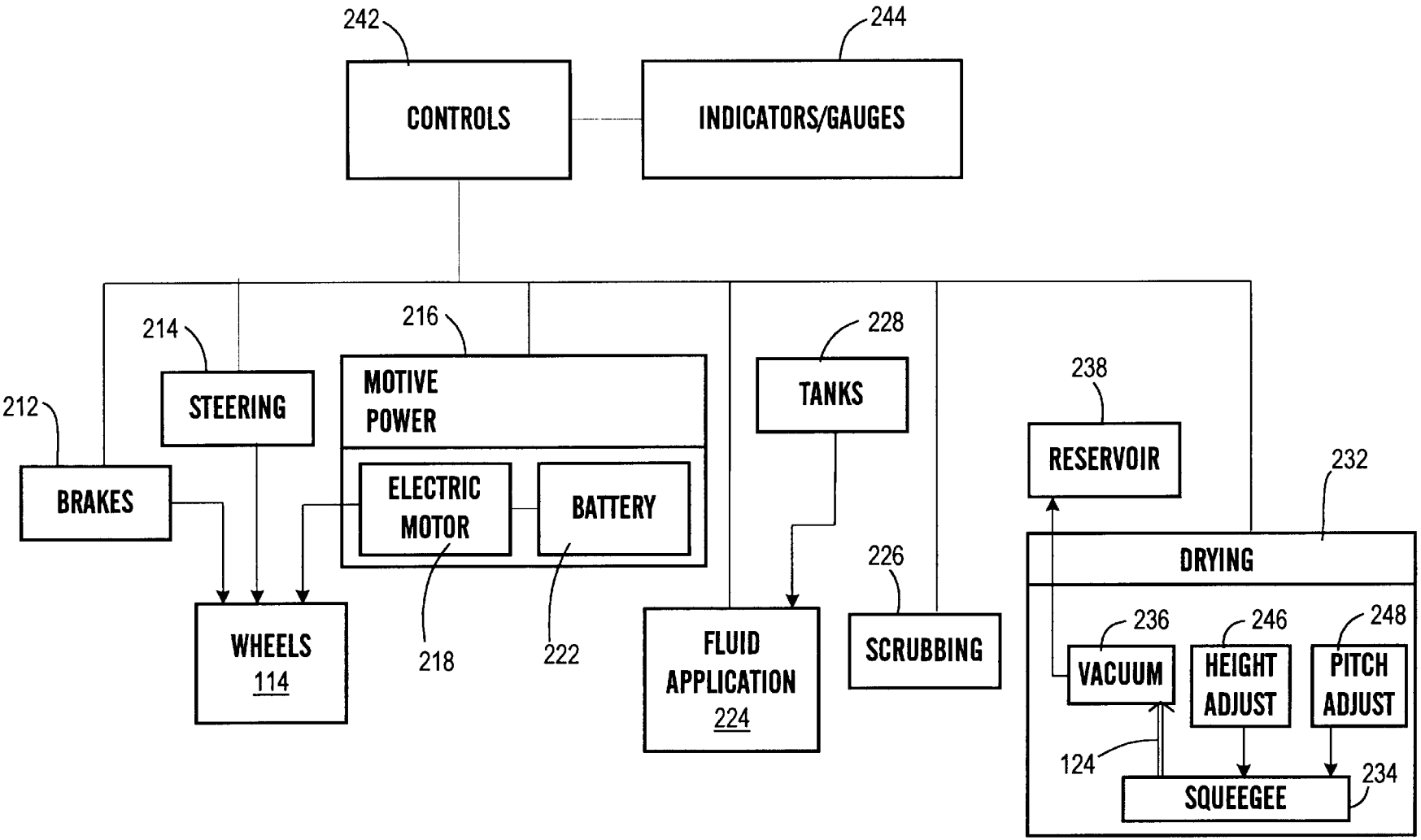
FIG. 2 is a block diagram of systems included in a floor maintenance device of a type which may used in connection with the present invention.

As shown in FIG. 1, a floor maintenance device 112 may be provided with wheels 114*a*, 114*b* for moving the floor maintenance device 112 over the floor 116 which is to be worked upon. The floor maintenance device 112 may include a number of components including components for braking and steering 212, 214 (FIG. 2), motive power (when the floor maintenance device 112 is at least partially self-propelled) 216 such as an electric motor 218 coupled to a battery 222, a fluid application device 224 such as one or more nozzles 118 receiving fluid from one or more tanks 228, a scrubbing system 226 such as a rotating scrub brush 122 and a drying system 232 including, as noted above, one or more squeegees 234 coupled by a vacuum hose 124 to a vacuum 236 for vacuuming fluid into a reservoir 238. The various components may be coupled to controls 242 to permit an operator to, for example, turn on and off the various components, and the operator may also be provided with various gauges, lights or other indicators 244 to assist in operating the floor maintenance device 112.

In the configuration of FIG. 1, the squeegee assembly 234 is positioned above the floor 116 and permitted to move with respect to the floor e.g. by coupling to one or more wheels 128 and is linked 132 to the vehicle portion of the floor maintenance device 112. The type of link 132, wheel 128 and components therebetween 134 affect the attitude of the squeegee assembly 235. Preferably, the squeegee assembly 234 is coupled so as to permit height adjustment 246 and/or pitch adjustment 248. By height adjustment, it is generally meant that the vertical distance 138 between the floor surface 116 and the top of the squeegee blades may be adjusted. Adjustment of height 138 generally provides for an adjustment of the amount of pressure which the squeegee blades 142*a,* 142*b* exert on the floor 116 and the amount of flare, i.e. the distance 144 which the lower edge (floor contact edge) 146 of the squeegee blade 142*b* extends from the plane 148 which is tangent to the major portion of the squeegee blade 142*b* (or its cross-section). When the squeegee blade 142*b* is configured to lie along an arc 312 (FIG. 3), the tangent plane 148 may be taken as the plane tangent to the major portion of the squeegee blade 142*b* at the apex 314 of the arc 312. Pitch adjustment 248 refers to adjustment of the angle 152 between the tangent plane 148 and floor surface 116.

Figure 3:
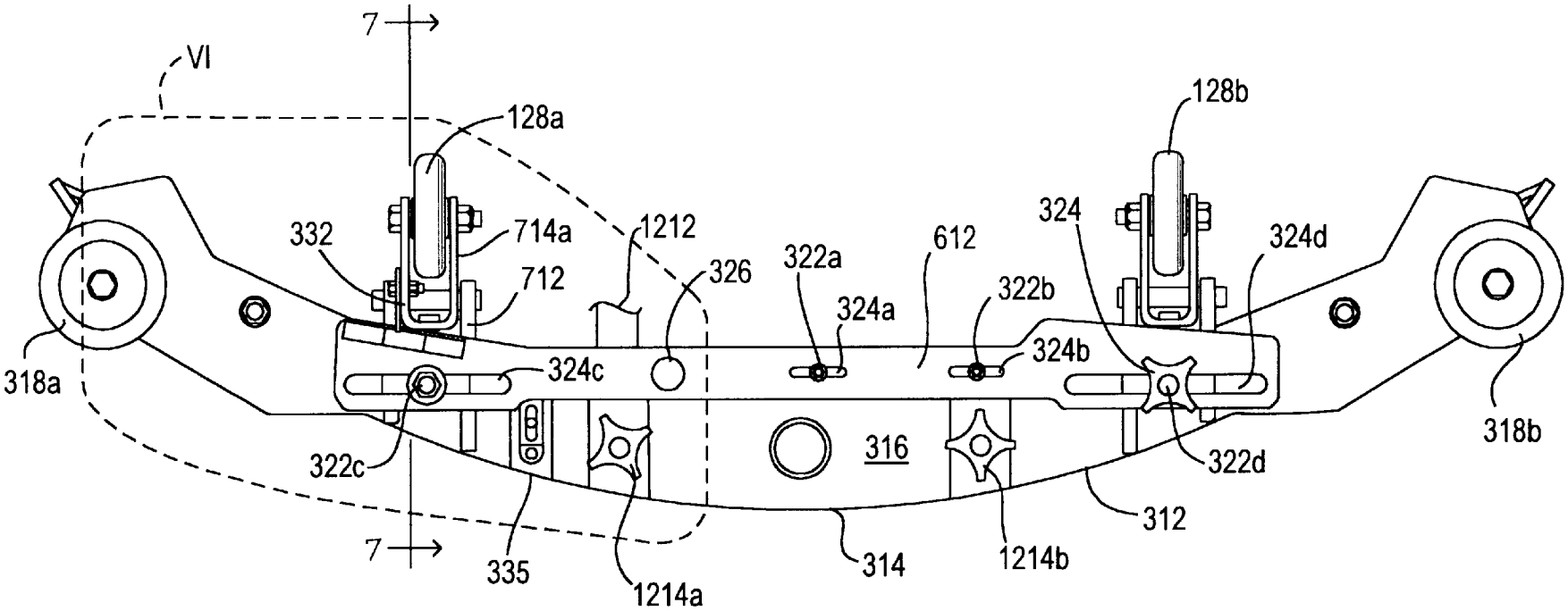
FIG. 3 is a top plan view of a squeegee assembly according to one embodiment of the present invention.
Figure 4:
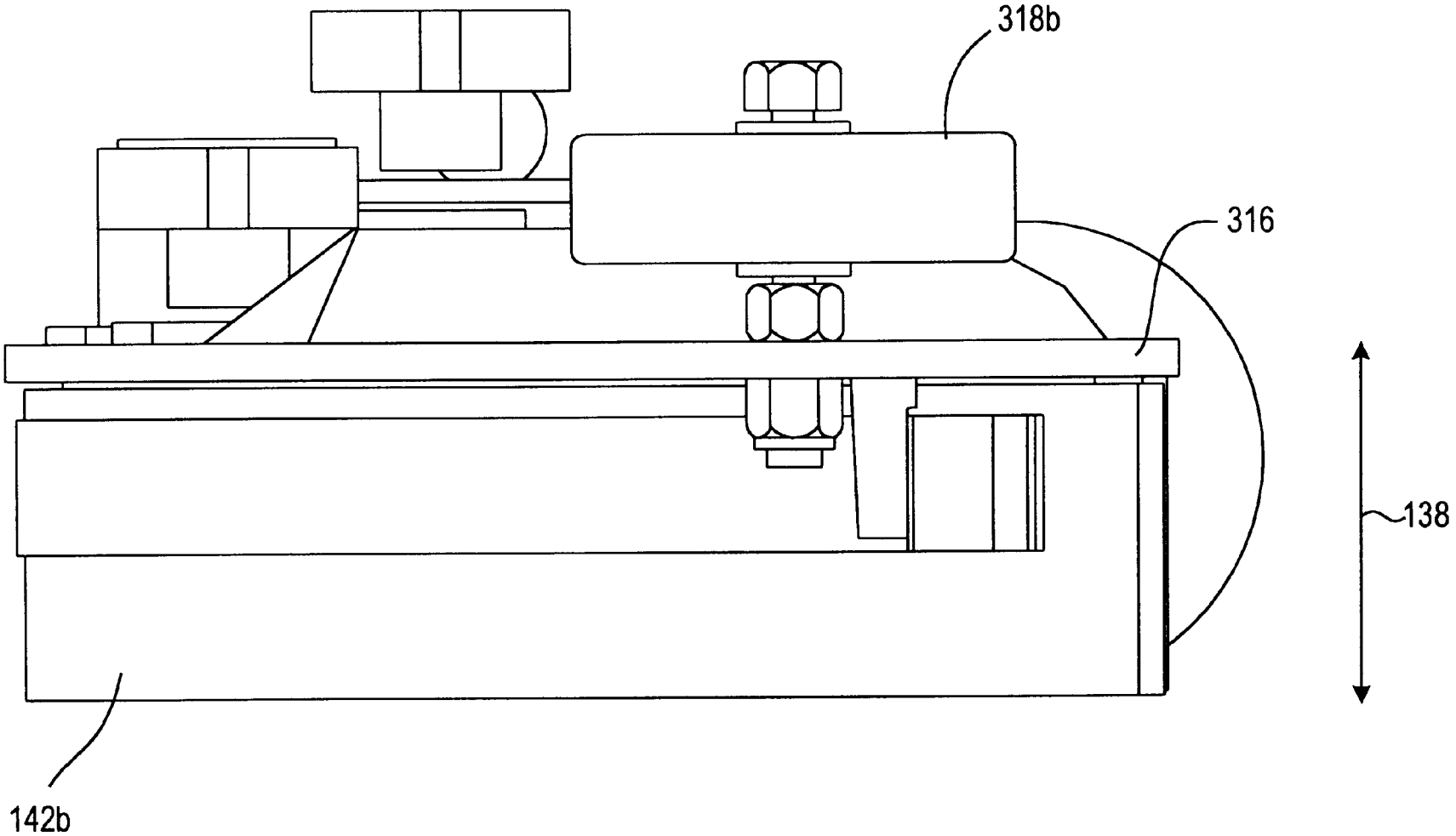
FIG. 4 is a right elevational view of the assembly of FIG. 3.
Figure 5:
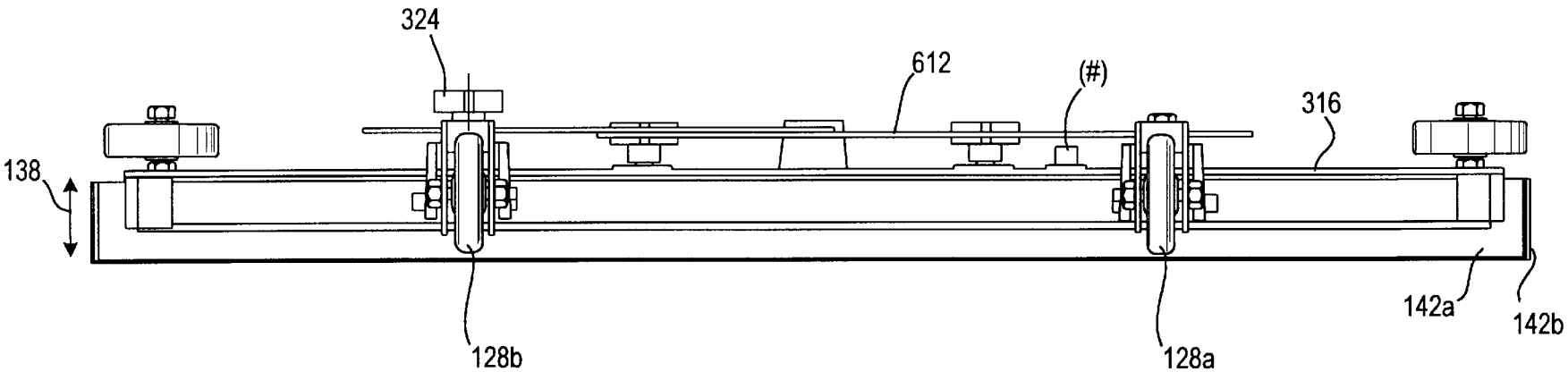
FIG. 5 is a front elevational view of the assembly of FIG. 3.

In the embodiment depicted in FIG. 3, a squeegee assembly includes a deck portion 316 which will typically be substantially horizontal when the squeegee is properly adjusted. Outer and inner squeegee blades 142*b,* 142*a* extend downwardly, substantially perpendicular to the deck 316, along the arc 312. Wheels 128*a,* 128*b* ride along the floor surface 116 and maintain the deck 316, and thus the dependent squeegee blades 142*b,* 142*a,* at a height 138 with respect to the floor 116 which is preferably adjustable as described more fully below. Rotatable horizontal wheels or bumpers 318*a,* 318*b* reduce the potential for damage from collision with objects such as walls, shelves and the like.

Figure 6:
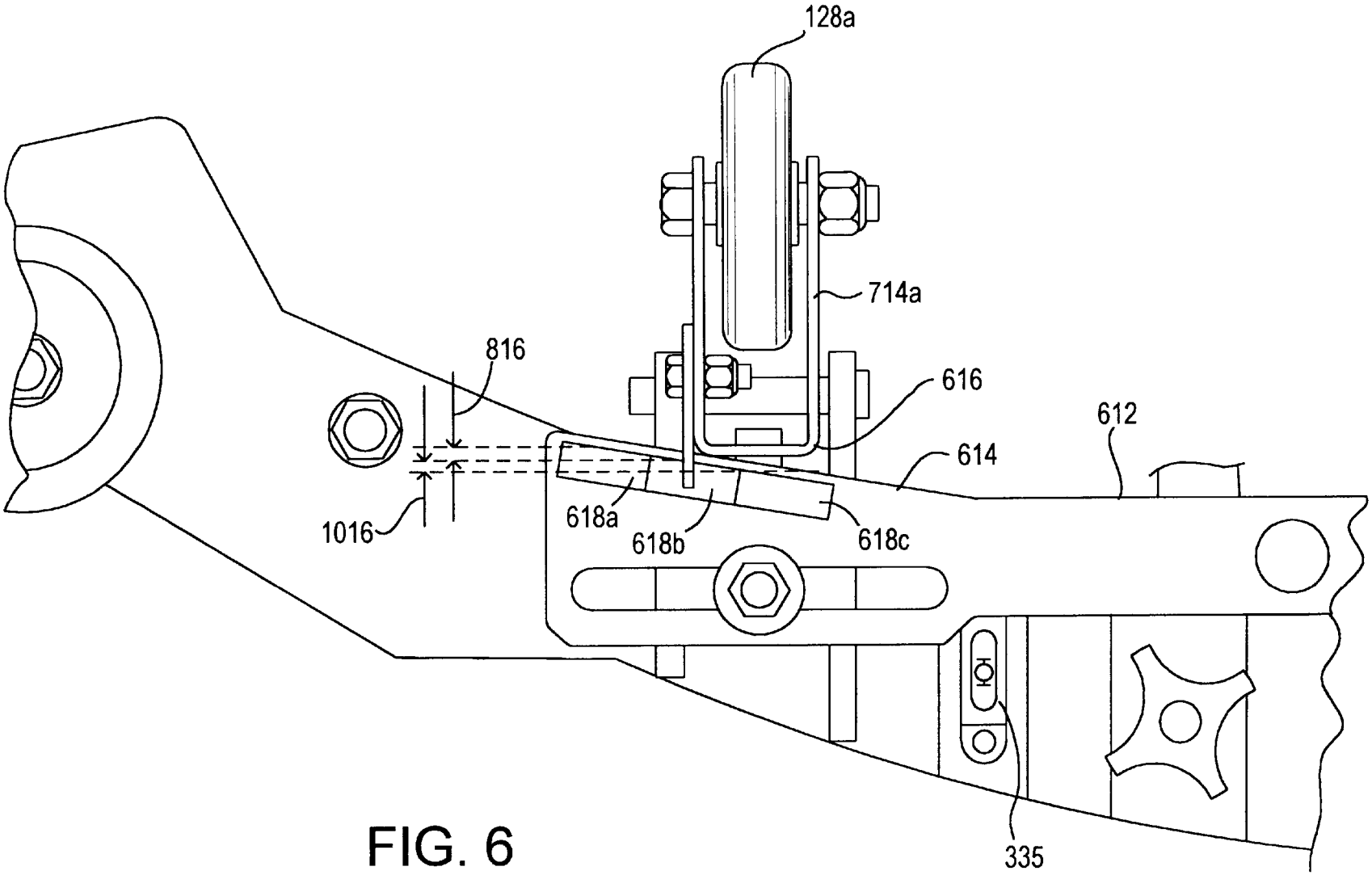
FIG. 6 is an enlarged view of Region VI of FIG. 3.
Figure 7:
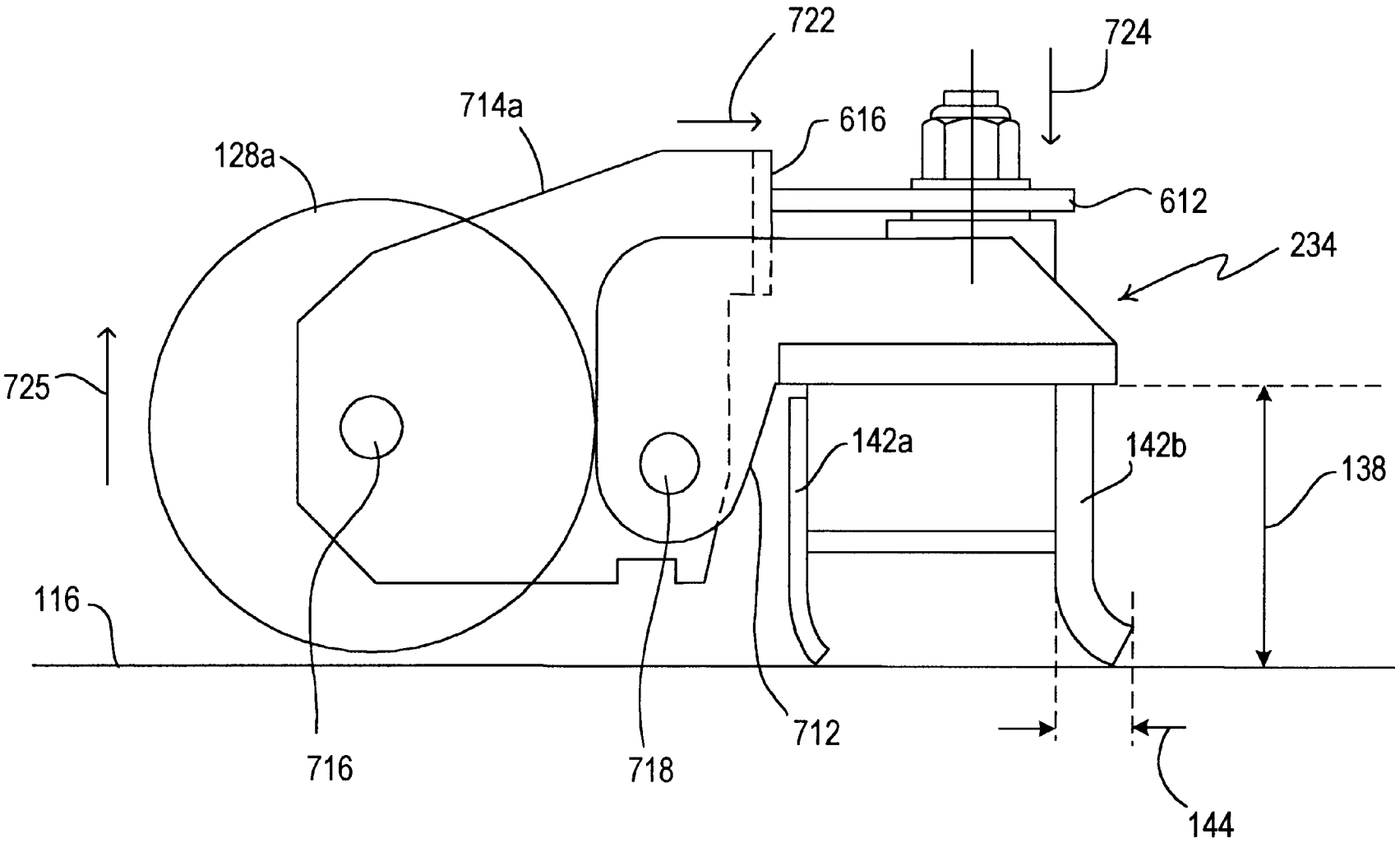
FIG. 7 is a cross-sectional view taken along line 7—7 of FIG. 3.

As best seen in FIG. 7, the wheel 128*a* is coupled to a deck bracket 712 by a generally channel-shaped pivoting link 714*a*. The pivoting link 714*a,* in the absence of other constraints, is free to pivot about the bracket axis 718. As best seen in FIG. 6, a cam plate 612 contains a cam surface 614 configured to contact an outer surface of the link 714 which thus acts as a cam follower 616. As best seen in FIG. 7, the result of contact of the cam follower 616 with the camming edge 614 of the cam plate 612 is to limit the amount by which the link 714*a* may pivot clockwise 722 (in the view of FIG. 7). If desired, the pivot axis 718 may be provided with a torsion spring or similar device for urging the link 714*a* clockwise 722 and thus loading the wheel upwardly 725. As a result, particularly when the squeegee assembly 234 is urged generally downward 724 (in a manner to be described more thoroughly below) link 714*a* is urged clockwise 722 to contact cam surface 614 as shown in FIG. 7, which establishes the height of pivot point 718 and thus establishes the height 138 of the squeegee assembly 234.

Figure 8:
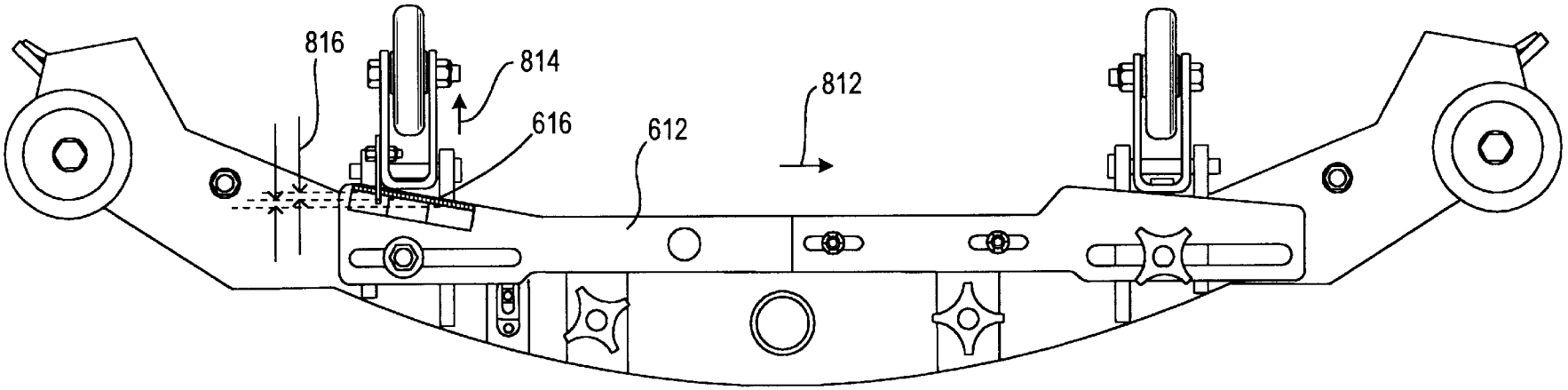
FIG. 8 is a top plan view similar to the view of FIG. 3 but showing the assembly in a normal floor position.
Figure 9:
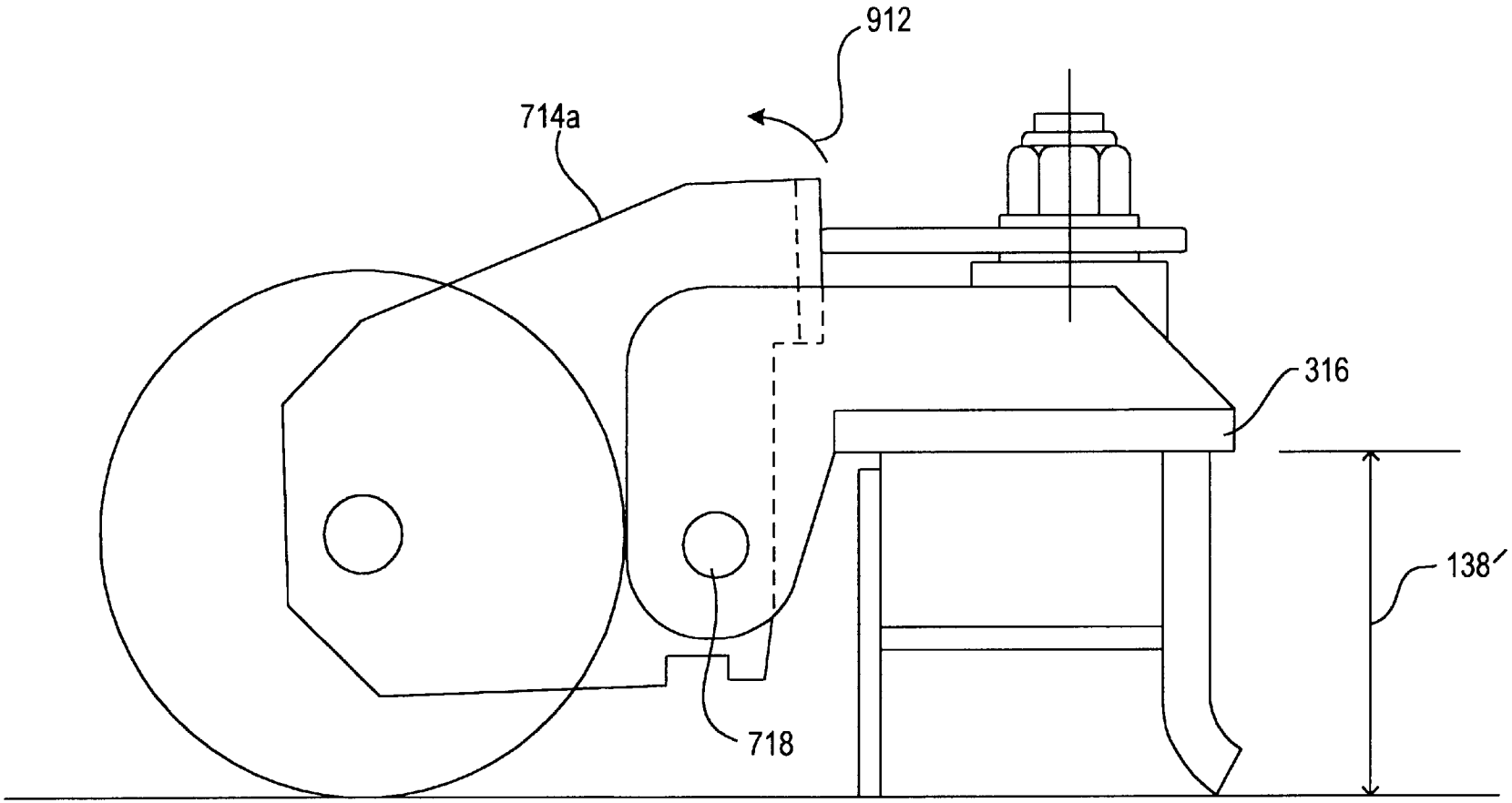
FIG. 9 is a cross-sectional view similar to the view of FIG. 7 but showing the assembly in a normal floor position.

The height 138 in the configuration shown in FIG. 7 is a height which is typically used in connection with maintenance of a tile floor. When it is desired to perform maintenance of a (relatively smooth) non-tile floor, such as a cement floor, it is generally desired to increase the squeegee height 138 thus achieving a decreased flare 144. To effect this adjustment, the camming plate 612 is moved laterally 812 to the position shown in FIG. 8. As seen in FIG. 8, the result of this movement 812 is that the cam follower 616 is forced by the camming surface to move forward 814 a distance 816 thus causing the link 714*a* to pivot counterclockwise (in the view of FIG. 9) 912. A comparison of FIG. 7 with FIG. 9 shows that such pivoting 912 causes the pivot axis 718 to be raised, thus lifting the deck 316 to a new height 138' greater than height 138 in the configuration in FIG. 7.

Figure 10:
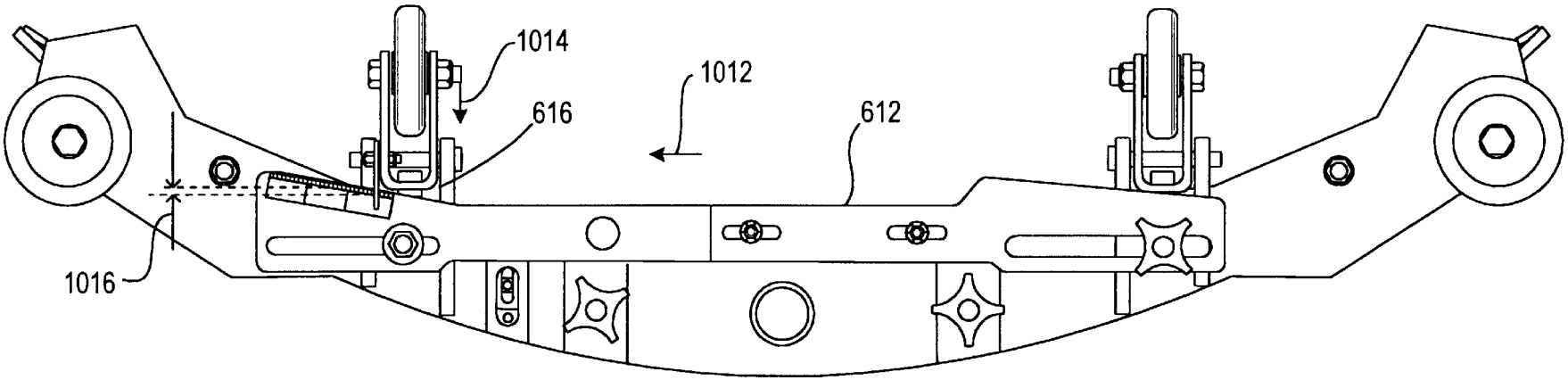
FIG. 10 is a top plan view similar to the view of FIG. 3 but showing the assembly in an extreme floor position.
Figure 11:
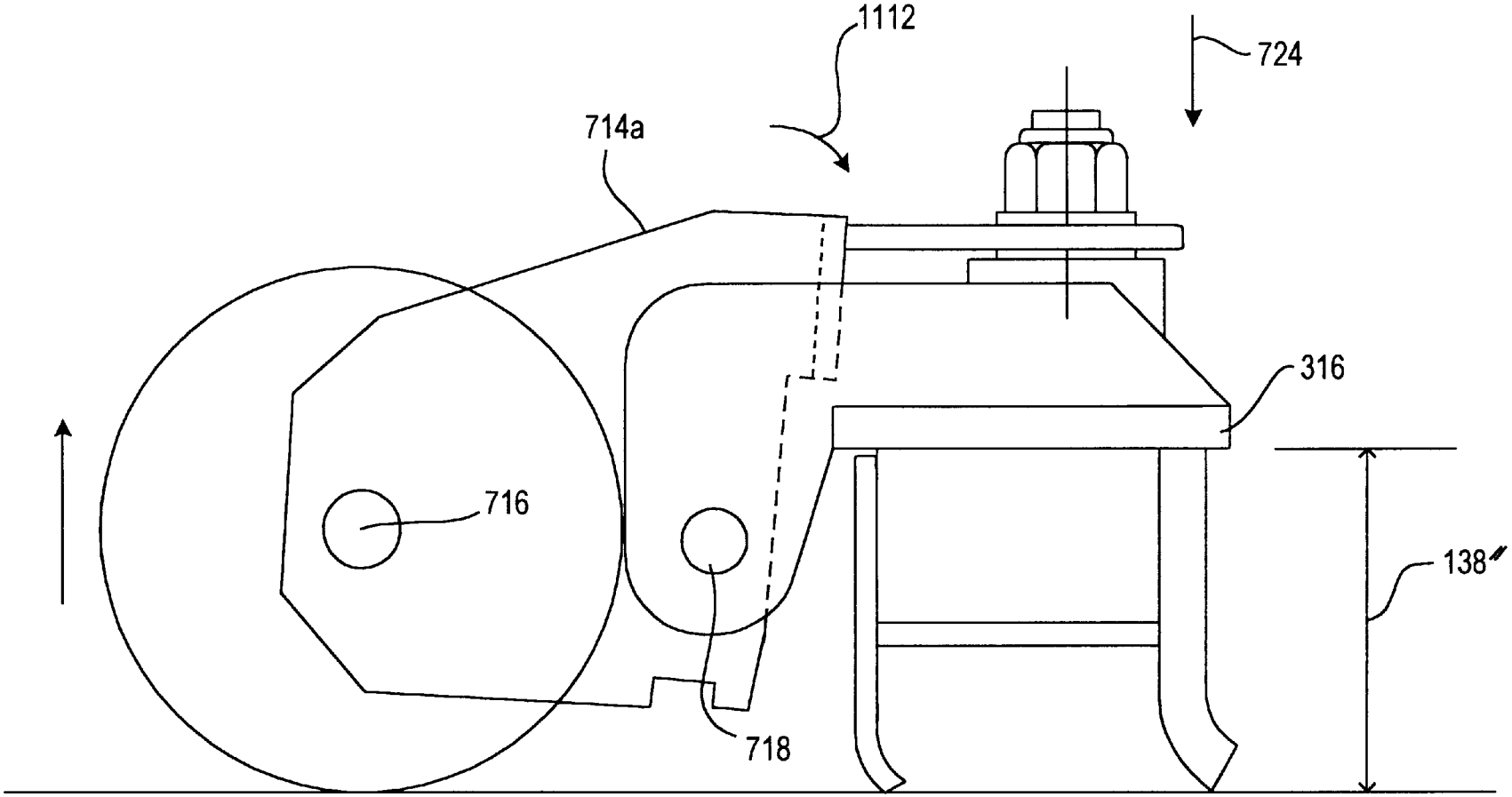
FIG. 11 is a cross-sectional view similar to the view of FIG. 7 but showing the assembly in an extreme floor position.

In a similar manner, when it is desired to decrease the squeegee height and increase the flare, e.g. for use with "button" floors or other highly textured floors, the camming plate 612 is moved in the opposite lateral direction 1012 (FIG. 10) so that the cam follower surface 616 moves rearward 1014 a distance 1016 so that downward load 724 causes the link 714*a* to rotate clockwise 1112 (in the view of FIG. 11) so that the pivot point 718 is moved downward and thus the deck 316 is moved downward thus decreasing the squeegee height to a new height 138" less than that depicted in FIG. 7.

As shown in FIG. 6, the lateral movement of the camming plate 612 is guided by pins 322*a,b,c,d* protruding from the deck through slots 324*a,b,c,d* in the camming plate 612. In the depicted embodiment, one of the pins 322 is provided with threads for engagement with a threaded knob 324. The knob 324 may be manually tightened to fix or lock the camming plate 612 in the desired lateral position, thus maintaining the desired squeegee height. A fixed knob 326 is provided, in the embodiment of FIG. 3, to assist in lateral positioning of the camming plate.

A second wheel assembly 128*b* and the right portion of the camming bar 612 are similarly constructed so that squeegee height in the vicinity of the second wheel 128*b* will be substantially equal to that of squeegee height in the vicinity of the first wheel 128*a*.

In the embodiment depicted in FIG. 3, a pointer 332 is coupled to the link 714*a* and the camming bar 612 is provided with indicia such as colored regions 618*a,b,c* as an indication of the current height adjustment value.

Figure 12A:
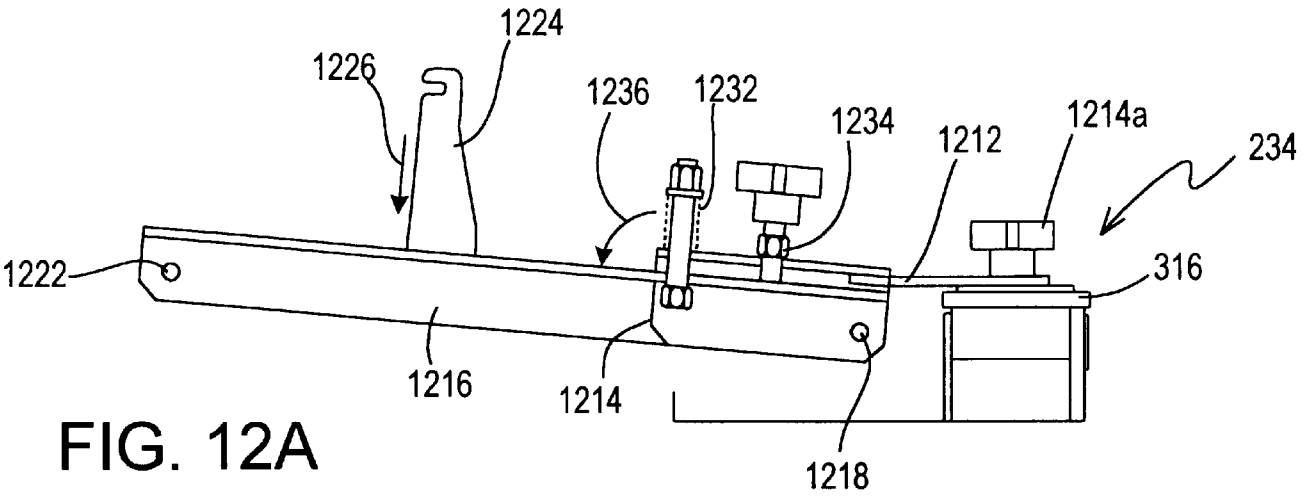
FIG. 12A is a cross-sectional view of a squeegee assembly and an adjustable coupling to a vehicle frame according to an embodiment of the present invention.

One manner of coupling the squeegee assembly 234 to the vehicle portion of the floor maintenance device 112 is depicted in FIG. 12*a*. In this configuration, a forward projecting arm 1212 of a squeegee assembly 234 is coupled at its rearward edge to the squeegee assembly 234 by a mounting knob. An arm 1212 is coupled at its forward end to a pitch adjustment channel 1214. A mounting arm 1216 is pivotally attached at its rearward edge to the rear portion of the pitch adjustment channel 1214 defining a first pitch adjustment channel pivot 1218 and is pivotally mounted at its forward end to the vehicle portion frame to define a mounting pivot 1222. A spring-mount 1224 is used to engage a spring (not shown) for providing squeegee down pressure 1226 to the arm 1216 and, thus, in turn, to the squeegee assembly 234. The degree of pivoting of the pitch adjustment channel 1214 with respect to the mounting arm 1216 (about pivot point 1218) is controlled by the downward-force spring 1232 and threaded adjustment knob and shaft 1234. The spring 1232 urges the pitch adjustment channel 1214 in a counterclockwise direction 1236 about pivot point 1218 and the amount of such counterclockwise pivoting 1236 is limited by the protrusion of the threaded shaft 1234 which bears against the upper surface of the mounting arm 1216.

Figure 12B:
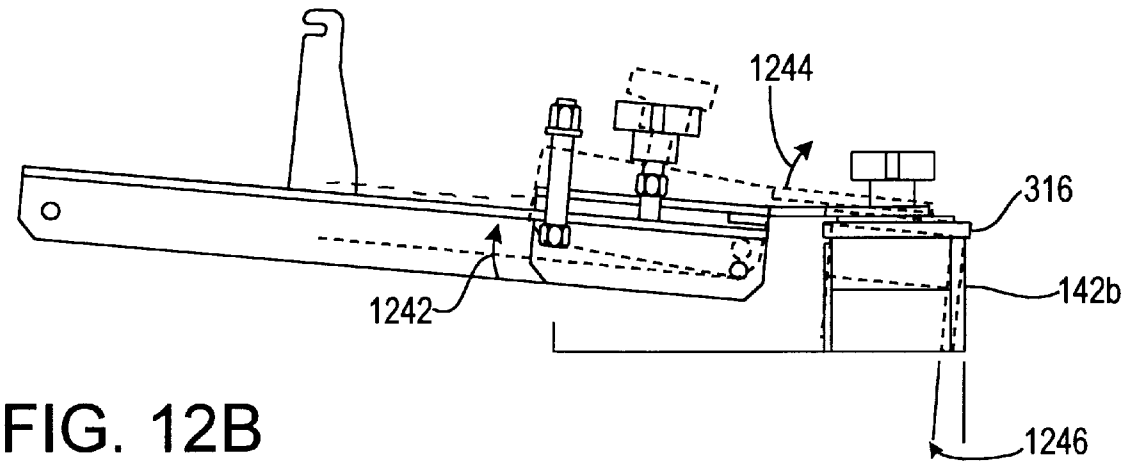
FIG. 12B is a cross-sectional view similar to the view of FIG. 12A showing a pitched squeegee assembly in phantom lines.

The manner in which the assembly of FIG. 12A is used to adjust the pitch of the squeegee 234 can be see by comparing FIG. 12A with FIG. 12B. In FIG. 12B, phantom lines depict the angular position of the mounting arm, adjustment channel, and squeegee assembly after the pitch adjustment knob and the threaded shaft 1234 have been rotated so that the threaded shaft 1234 protrudes further through the pitch adjustment channel 1214 than the protrusion depicted in FIG. 12A. Thus, when the threaded shaft 1234 protrudes further through the top of the pitch adjustment channel 1214, the pitch adjustment channel is caused to pivot counterclockwise (i.e. against the urging of spring 132) to assume the position shown in phantom lines in FIG. 12B. Because the arm 1212 is rigidly coupled to the pitch adjustment channel 1214, the arm 1212 is also rotated 1244 causing the pitch angle 1246 of the squeegee blade 142 to change. In this manner, it can be seen how adjustment of the pitch adjustment knob 1234 results in a change 1246 in the pitch of the squeegee blade 142*b*.

In the embodiment depicted in FIG. 3, a bubble-level 335 provides an indication or information regarding the current pitch adjustment value of the deck 316 and thus of the squeegee blade. In a typical situation, it is desired to maintain the squeegee blade pitch angle substantially vertical (i.e. to maintain the deck 316 substantially horizontal) when the floor surface which the floor maintenance device wheels 114*a*, 114*b* are positioned on is horizontal. Accordingly, it may be desirable to provide one or more levels coupled to the floor maintenance device 112 so that an operator may assure the floor maintenance device 112 is substantially level before adjusting squeegee pitch.

In light of the above description, a number of advantages of the present invention can be seen. The present invention facilitates adjustment of a squeegee, including adjustment of height, pressure, flare, and/or pitch of squeegee blades with respect to a floor surface, preferably in a manner which is easier, less labor-intensive, less time-consuming, more accurate, and more reproducible than previous adjustment apparatus and methods. The present invention permits squeegee adjustment to be accomplished manually, without the need for tools. The present invention preferably provides indications, readouts, or feedback indicating the current level of or value squeegee adjustments. Advantages of the present invention can be enjoyed in a number of fashions including implementing embodiments of the present invention in newly-manufactured floor maintenance devices, in used, repaired, rebuilt, or retrofitted floor maintenance devices, in repair or retrofit kits, or components, or by using features of the present invention in parts sold in connection with any of the above.

A number of variations and modifications of the present invention can be used. Certain aspects of the invention can be used without using other aspects. For example, it is possible to provide for squeegee height adjustment without providing for indicia readouts or feedback. It is possible to provide for height adjustment without providing for pitch adjustment or vice-versa. Although adjustment of a rear squeegee is depicted, similar adjustments may be provided for other squeegees such as side squeegees. Although a cam system has been described in connection with adjusting height, other height adjustment systems can be provided including a rack-and-pinion system, a traveling screw system, an electric motor system, and the like. Although the depicted system provides for arbitrarily small adjustments and adjustments to any position within a range, it is possible to provide for a finite number of discrete possible or preferred positions. Although a pointer and color field height indicator is described, other indicators can be used including gauges, dials, sensors coupled to digital or similar displays, and the like. Pitch or level indicators other than a bubble-level can be used including electronic level indicators. Although the depicted embodiments provide for adjustment and locking knobs substantially adjacent the squeegee assembly, it is possible to provide for remote control such as using cables, hydraulics or electronic controls for manipulation by an operator (such as an operator in a riding machine) control by an automated or semi-automated system such as a microprocessor-based control, central remote control, e.g. to permit squeegee adjustment of any of a variety of floor maintenance devices from a central remote location, and the like. Indicia showing squeegee adjustment values may be coordinated with other features or components such as color-coding height indicia to squeegee colors (which may be used to indicate squeegee types or characteristics). This embodiment is particularly useful when it is desired to have the ability to readily install different types of squeegees (such as squeegees having different blade thicknesses, compositions, resiliencies and the like) and to readily adjust squeegee height or flare to coordinate with squeegee type.

The present invention can be used in connection with a variety of floor maintenance devices including e.g., those available from Windsor Industries, Inc., Englewood, Colo., and/or devices similar to those described in U.S. Pat. Nos. 5,555,596, 5,467,500 and Ser. No. 08/537,272, filed Sep. 29, 1995.

Although the application has been described by way of a preferred embodiment and certain variations and modifications other variations and modifications can also be used, the invention being defined by the following claims:

What is claimed is:

1. Squeegee adjustment apparatus usable in connection with a floor maintenance device comprising:

a deck, coupled to said floor maintenance device, for holding at least a first squeegee blade;

a control, coupled to said deck, movable from a first position establishing a first height of said deck, to a second position, establishing a second height of said deck, different from said first height;

an engagable lock, coupled to said control, for selectably maintaining said deck at said first or second height; and a pointer coupled to said control for pointing to indicia indicating current value of deck height.

2. Squeegee adjustment apparatus usable in connection with a floor maintenance device comprising:

a deck, coupled to said floor maintenance device, for holding at least a first squeegee blade;

a control, coupled to said deck, movable from a first position establishing a first pitch of said deck, to a second position, establishing a second pitch of said deck, different from said first pitch; and an inclination indicator coupled to said deck which indicates current pitch of a squeegee blade.

3. Squeegee adjustment apparatus usable in connection with a floor maintenance device comprising:

first means for coupling at least a first squeegee device to said floor maintenance device;

second means, coupled to said first means, to facilitate adjusting at least a first attitude parameter of said first squeegee device; and means, coupled to said second means, for indicating a current value of said first attitude parameters.

4. Apparatus, as claimed in claim 3, wherein said first attitude parameter is selected from the group consisting of height and pitch.

5. A method for squeegee adjustment usable in connection with a floor maintenance device comprising:

coupling at least a first squeegee to said floor maintenance device; and manually moving a first control to adjust at least a first attitude parameter of said squeegee device; and coupling an indicator, which indicates a current value of said first attitude parameter, to said floor maintenance device.

6. Squeegee adjustment apparatus, as claimed in claim 1, wherein said indicia include colors which correspond to squeegee colors for indicating squeegee type.

7. Squeegee adjustment apparatus, as claimed in claim 2, wherein said inclination indicator includes a bubble level.

* * * * *